US008208665B2

(12) United States Patent
Pfannenmüller et al.

(10) Patent No.: US 8,208,665 B2
(45) Date of Patent: Jun. 26, 2012

(54) HEARING APPARATUS WITH AUTOMATIC SELF TRIMMING AND CORRESPONDING METHOD

(75) Inventors: Gerhard Pfannenmüller, Oberasbach (DE); Gottfried Rückerl, Nürnberg (DE); Gunter Sauer, Erlangen (DE); Ulrich Schätzle, Forchheim (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1206 days.

(21) Appl. No.: 12/008,081

(22) Filed: Jan. 8, 2008

(65) Prior Publication Data

US 2008/0165995 A1 Jul. 10, 2008

Related U.S. Application Data

(60) Provisional application No. 60/879,779, filed on Jan. 10, 2007.

(51) Int. Cl.
*H04R 25/00* (2006.01)

(52) U.S. Cl. ..... 381/312

(58) Field of Classification Search ..... 381/312
See application file for complete search history.

(56) References Cited

U.S. PATENT DOCUMENTS

| | | | | |
|---|---|---|---|---|
| 6,828,868 | B2 * | 12/2004 | Sano | 331/117 R |
| 7,292,698 | B2 * | 11/2007 | Niederdrank et al. | 381/315 |
| 2003/0179896 | A1 * | 9/2003 | Putvinski | 381/323 |
| 2004/0175009 | A1 | 9/2004 | Niederdrank et al. | |

FOREIGN PATENT DOCUMENTS

| | | | |
|---|---|---|---|
| EP | 1267491 | B1 | 12/2002 |
| JP | 10187916 | A | 7/1998 |
| JP | 10320519 | A | 12/1998 |
| JP | 2004248281 | A | 9/2004 |
| JP | 2005011009 | A | 1/2005 |

OTHER PUBLICATIONS

A. Kral, F. Benbahani, A.A. Abidi; "RF-CMOS Oscillators with Switched Tuning"; Proceedings of the IEEE 1998, Custom Integrated Circuits Conference, May 11-14, 1998; pp. 555-558; Abstract.

Ulrich Tietze, Christoph Schenk; "Halbleiter-Schaltungstechnik (Semi-conductor circuit technology)"; 1999; pp. 1284-1286; Edition 11; ISBN 3-540-64192-0; Springer, Berlin.

* cited by examiner

*Primary Examiner* — David Vu
*Assistant Examiner* — Brandon Fox

(57) ABSTRACT

The aim is for an LC oscillator circuit of a hearing apparatus to be operated on a sustained basis in a desired frequency range. To this end, a hearing apparatus is proposed having an oscillator and a trimming facility for trimming the oscillation frequency of the oscillator. A control facility controls the oscillation frequency of the oscillator with the aid of the trimming facility in accordance with a predetermined desired value. An automatic self-trimming of a wireless transmission system in a hearing apparatus and in particular in a hearing device is thus possible.

16 Claims, 2 Drawing Sheets

HEARING APPARATUS WITH AUTOMATIC SELF TRIMMING AND CORRESPONDING METHOD

CROSS REFERENCE TO RELATED APPLICATIONS

The present application claims the benefit of the provisional patent application filed on Jan. 10, 2007, and assigned application No. 60/879,779, and is incorporated by reference herein in its entirety.

FIELD OF THE INVENTION

The present invention relates to a hearing apparatus with an oscillator and a trimming facility for trimming the oscillation frequency of the oscillator. Furthermore, the present invention relates to a corresponding method for controlling a hearing apparatus. The term "hearing apparatus" is understood in this context to mean in particular a hearing device, but also includes other portable audio devices such as a headset, earphones, etc.

BACKGROUND OF THE INVENTION

Hearing devices are portable hearing apparatuses which are used to provide hearing assistance to the hearing-impaired. In order to accommodate the multiplicity of individual requirements, different designs of hearing devices are provided, including behind-the-ear hearing devices (BTE), in-the-ear hearing devices (ITE) and concha hearing devices. The hearing devices cited by way of example are worn on the outer ear or in the auditory canal. In addition to these, however, bone conduction hearing aids as well as implantable or vibrotactile hearing aids are also available on the market. The damaged hearing is herewith stimulated either mechanically or electrically.

Essential components of the hearing devices include in principle an input transducer, an amplifier and an output transducer. The input transducer is typically a receiving transducer, e.g. a microphone and/or an electromagnetic receiver, e.g. an induction coil. The output transducer is mostly realized as an electroacoustic converter, e.g. a miniature loudspeaker, or as an electromechanical converter, e.g. a bone conduction receiver. The amplifier is usually integrated into a signal processing unit. This basic configuration is shown in FIG. 1 by way of the example of a behind-the-ear hearing device. One or more microphones 2 for recording the ambient sound are incorporated in a hearing device housing 1 that is designed to be worn behind the ear. A signal processing unit 3, which is likewise integrated into the hearing device housing 1, processes the microphone signals and amplifies them. The output signal of the signal processing unit 3 is transmitted to a loudspeaker and/or receiver 4, which outputs an acoustic signal. In certain cases the sound is transmitted to the ear drum of the hearing device wearer via a sound tube which is secured in the auditory canal by means of an otoplastic. The hearing device and in particular the signal processing unit 3 are supplied with power by means of a battery 5 which is likewise integrated into the hearing device housing 1.

Modulatable LC oscillator circuits are used for the energy-efficient realization of a wireless data transmission between hearing devices. The LC circuit can be used here both for receiving as well as for transmitting. The frequency-determining components of such circuits must nevertheless be precisely attuned to the desired values. Deviations from the desired value, which are caused by means of manufacturing tolerances, can be corrected by a one-off trimming of the resonance circuit during the manufacturing process. The influence of temperature effects and parameter drift as a result of ageing is however not covered thereby. Special modulation methods such as QPSK or BPSK for instance nevertheless require a high absolute precision of the frequency, which also requires a compensation of temperature effects and ageing.

With hearing devices, which are to be exclusively wirelessly programmable (without a conventional programming interface), it is also problematical that the wireless programming is only then possible when the LC circuit of the wireless hearing devices transmit/receive circuit has already been correctly trimmed. Controlling the trimming by means of an external programming device is in this way not possible.

With previous hearing devices, a modulation method is used for data transmission, the precision requirements of which can be fulfilled with a one-off trimming during the manufacturing process. The LC oscillator is started here and the current oscillator frequency is measured by a frequency counter integrated onto the hearing device chip. This measurement value can then be read out by way of the programming interface. The PC used for programming determines the capacity value required for compensation from the deviation from the desired value. A programmable capacity matrix which is likewise integrated onto the chips applies this capacity value, said capacity matrix now likewise being configured by the PC by way of the programming interface.

Tietze, U.; Schenk; Ch.: Halbleiter-Schaltungstechnik, [Semiconductor circuit technology], Edition 11, Berlin [inter alia]: Springer, 1999, pages 1284-1286, ISBN 3-540-64192-0 discloses a phase locked loop (PLL). Its aim consists of adjusting the frequency of an oscillator such that it corresponds to the frequency of a reference oscillator, and in fact so precisely that the phase shift does not run away. A phase locked loop can be realized for instance with the aid of a voltage-controlled oscillator.

The article Kral, A.; Behbahani, F.; Abidi, A. A.: RF-CMOS oscillators with switched tuning. In: Proceedings of the IEEE 1998, Custom Integrated Circuits Conference, 1998, pages 555-558 discloses an RF-CMOS oscillator, which can be tuned using a connectable capacitor.

SUMMARY OF THE INVENTION

The object of the present invention thus consists in maintaining a long-lasting highly precise trimming of the resonance circuit.

This object is achieved in accordance with the invention by a hearing apparatus with an oscillator and a trimming facility for trimming the oscillation frequency of the oscillator as well as a control facility for automatically controlling the oscillation frequency of the oscillator with the aid of the trimming facility according to a predetermined desired value.

Furthermore, provision is made in accordance with the invention for a method for controlling a hearing apparatus by controlling a data processing of the hearing apparatus using an oscillator and trimming the oscillation frequency of the oscillator, with the trimming including an automatic controlling of the oscillation frequency of the oscillator in accordance with a predetermined desired value.

Advantageously, an automatic self trimming of a wireless transmission system of a hearing device is thus possible for instance. It is not necessary to seek a hearing device specialist for a simple trimming process.

The oscillator of the hearing apparatus preferably features an LC oscillating circuit, the resonance capacity of which can be trimmed by a capacity matrix of the trimming facility. The automatic adjustment of the matrix of trimming capacities allows a simple, predominantly automated basic trimming during manufacture. The required software can be very significantly simplified, since only a few control commands are then required.

The control facility can comprise a frequency counter, a window comparator and a flow control unit. These components allow the control circuit to be established in a simple manner.

In accordance with a special embodiment, the resonance coil of the LC oscillating circuit represents a transmit and receive antenna. The resonance coil herewith achieves a multiple functionality.

Provision can also be made for the oscillator, the trimming facility and the control facility to be arranged on one common chip. This reduces both the manufacturing effort and manufacturing costs.

A maximum time can also be predetermined for the control facility for controlling the oscillation frequency. This is particularly advantageous in conjunction with the capacity matrix, since the predetermined, discrete capacity values can be tuned at a predetermined time.

According to a further embodiment, provision is made for the trimming values to be stored in a memory of the hearing apparatus for several desired frequencies of the oscillator. The oscillator can thus be trimmed to several modulation frequencies for special modulation methods.

The hearing apparatus according to the invention can also comprise a time control facility in order to repeat the trimming at temporally predetermined intervals. The periodic repetition of the automatic trimming process effectively allows the compensation of ageing and temperature drift influences. The trimming can however also be triggered immediately before a data transmission from/to the hearing apparatus or immediately after the hearing apparatus has been switched on.

In the case of the corresponding configuration, the hearing apparatus and in particular the hearing device can also carry out the trimming process completely self-sufficiently after being switched on, without it being necessary to transmit control commands to the hearing device. The hearing device herewith calibrates the LC circuit automatically and is thus, briefly after switching on, also able to communicate with a wireless programming device. This point is a basic prerequisite for achieving the realization of an exclusively wirelessly programmable hearing device without programming contacts.

In some circumstances, the trimming is also triggered by an external command. The possibility of starting the trimming procedure by way of special control commands improves the test and analysis possibilities of the system and assists with the service concept.

BRIEF DESCRIPTION OF THE DRAWINGS

The present invention is described in more detail with reference to the appended drawings, in which.

DETAILED DESCRIPTION OF THE INVENTION

The exemplary embodiment illustrated in more detail below represents a preferred embodiment of the present invention.

Figure 1:
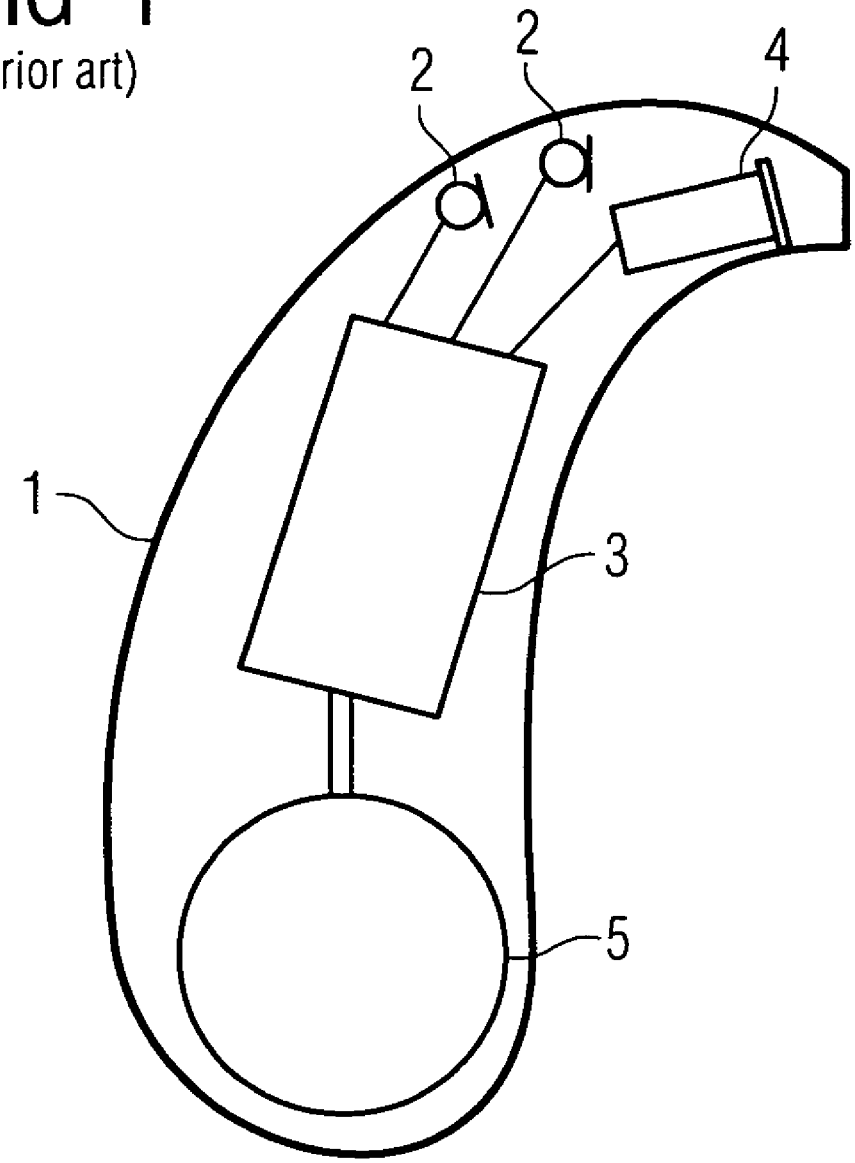
FIG 1 (Prior art)
FIG. 1 shows the main design of a hearing device.
Figure 2:
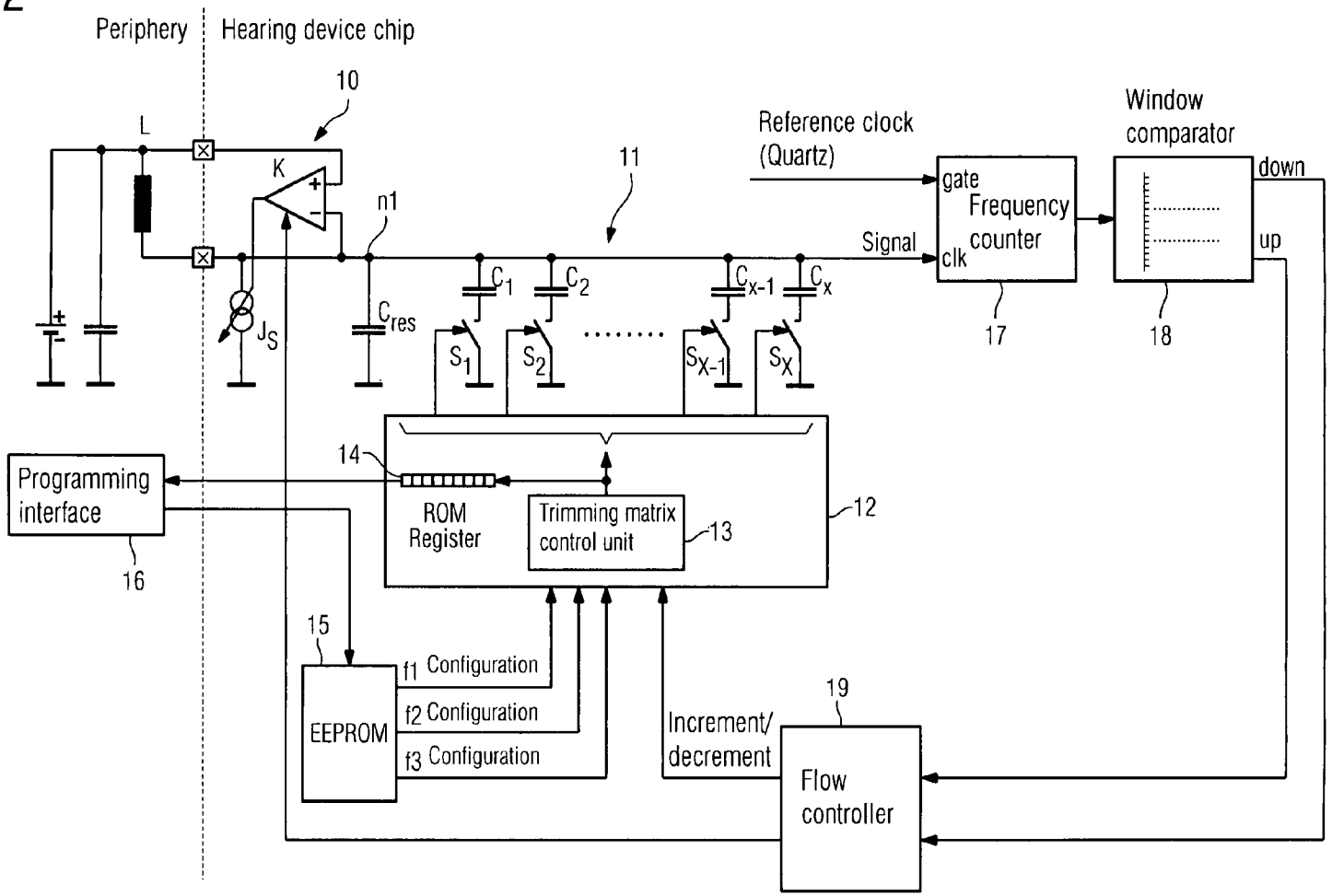
FIG. 2 shows a circuit diagram of part of a hearing device chip having a self-trimming transmission system.

FIG. 2 shows a part of a hearing device, the transmission system of which can automatically trim itself for a wireless transmission. The majority of components are located on a hearing device chip, while a transmit coil L is located in the periphery of the hearing device chip, but within the hearing device. The transmit coil L is connected to a terminal with two capacitors, said capacitors being used to stabilize the voltage and to close the resonance circuit in a high-frequency fashion.

A transmit circuit 10, which comprises a resonance capacitor $C_{res}$ as an essential component, is located on the hearing device chip, said resonance capacitor being connected on the one hand to earth and on the other hand to the transmit coil L by way of a node n1. Optionally, a further external resonance capacity can be connected in parallel to $C_{res}$ for frequency adjustment purposes. A further essential component of the transmit circuit is a comparator K, the two inputs of which are connected to the terminals of the transmit coil L and which control a current source $I_S$ on the output side. The current source $I_S$ is connected between earth and node n1.

A capacity matrix 11 is used to trim the resonance capacitor $C_{res}$, said capacity matrix being connected to the resonance capacitor $C_{res}$ by way of node n1. The capacity matrix 11 has several capacitors $C_1, C_2, \ldots, C_X$, which are each on the one hand connected to the node n1 and on the other hand to earth by way of a separate switch $S_1, S_2, \ldots, S_X$. Each of these switches $S_1, S_2, \ldots, S_X$ is controlled by way of a control facility 12, in order to trim the LC resonance circuit and to this end to connect the corresponding capacitors $C_1, C_2, \ldots, C_X$ in parallel with the resonance capacitor $C_{res}$. As an essential element, the control facility 12 contains a trimming matrix control unit 13 and also a ROM register 14, by way of which the trimming values can be read out. As an input parameter, the control facility 12 receives configuration data for different frequencies f1, f2, f3 from an EEPROM 15. The EEPROM 15 receives on its part data from a programming interface, which uses the transmit coil L if necessary. By contrast, trimming values can be read out from the ROM register 14 by way of the programming interface 16 by means of a programming device (not shown) for instance.

The node n1, which guides the transmit signal, is also connected to a frequency counter 17. The latter is also connected to a quartz for instance, which supplies a reference clock. The output signal of the frequency counter 17 is fed to a window comparator 18. This analyzes the frequency counter signal in order to determine whether it lies in a predetermined window. If the frequency counter signal lies above or below the window, the window comparator 18 emits a corresponding signal to a flow controller 19. This in turn supplies an increment/decrement signal to the control facility 12, so that a capacitor is more or less connected to the resonance capacitor $C_{res}$ for instance. The flow controller 19 also controls the comparator K.

The self trimming of the transmission circuit as claimed in FIG. 2 is carried out approximately according to the following scheme: The flow controller 19 first activates the transmitter and/or its comparator K. Consequently, the window comparator 18 determines whether the value determined by the frequency counter 17 lies within the tolerance range for the desired value, i.e. within the predetermined window. If this is the case, no further actions are necessary. If the frequency value is on the other hand too high, the value of the used trimming capacities $C_1, C_2, \ldots, C_X$ is increased by an increment. If the frequency value is too low, the value of the trimming capacities $C_1, C_2, \ldots, C_X$ is reduced by an increment. Continued repetition of this method allows the target range, i.e. the range predetermined by the window comparator 18, to be reached after a short amount of time. A fixed time is predetermined here as the abort criterion for the procedure for instance, within which time the maximum possible increment number can pass. Alternatively, the output signal of the window comparator 18 can also be used to detect that the target value has been reached. In this way, the otherwise conventional manually implemented method is automated with the individual steps "Activate transmitter", "Measure frequency", "Determine deviation from desired value", "Adjust capacity matrix".

The trimming value determined by the automatic self trimming method for the desired frequency can be read out by a programming device for instance after reaching the target value and stored in a permanent EEPROM 15. Alternatively, a direct takeover in the EEPROM 15 can also be realized, triggered for instance by a special control command. If the resonance circuit is to be adjusted for a number of different frequencies (e.g. for FSK modulation) the process is to be repeated for each of the frequencies.

To compensate for the ageing and temperature drift of the component parameters of the LC circuit, the afore-described automatic trimming procedure is repeated at suitable temporal intervals. A first request for the trimming procedure can be carried out immediately after switching on the hearing device for instance. Further requests for the trimming procedure can then be carried out shortly before a data transmission, so that the correct frequency adjustment is thus guaranteed for each transmitted data. Alternatively, a timer can also start the procedure at regular intervals.

In addition, the trimming procedure can also be explicitly started by way of an external control command. The control command for this is sent by way of the wired and/or wireless programming interface 16 for instance.

The invention claimed is:

1. A hearing apparatus, comprising:

an oscillator;

a trimming device that trims an oscillation frequency of the oscillator;

a control device that controls the oscillation frequency during the trimming according to a predetermined desired value; and a time control device that repeats the trimming at temporally predetermined intervals.

2. The hearing apparatus as claimed in claim 1, wherein the control device comprises a frequency counter, a window comparator, and a flow control unit.

3. The hearing apparatus as claimed in claim 1, wherein the oscillator comprises an LC oscillating circuit having a resonance capacitor that is trimmed by a capacity matrix of the trimming device.

4. The hearing apparatus as claimed in claim 3, wherein a resonance coil of the LC oscillating circuit represents a transmit and receive antenna.

5. The hearing apparatus as claimed in claim 1, wherein the trimming device, the control device, and a circuit element of the oscillator are arranged on a common chip.

6. The hearing apparatus as claimed in claim 1, wherein the control device controls the oscillation frequency in a predetermined maximum time.

7. The hearing apparatus as claimed in claim 1, wherein the hearing apparatus stores a plurality of trimming values for a plurality of desired oscillation frequencies.

8. The hearing apparatus as claimed in claim 1, wherein the trimming is triggered immediately before transmitting a data from or to the hearing apparatus.

9. The hearing apparatus as claimed in claim 1, wherein the trimming is triggered by an external command.

10. The hearing apparatus as claimed in claim 1, wherein the control device automatically controls the oscillation frequency during the trimming according to the predetermined desired value.

11. A method for controlling a hearing apparatus, comprising:

controlling a data processing of the hearing apparatus using an oscillator;

trimming an oscillation frequency of the oscillator using a trimming device; and controlling the oscillation frequency during the trimming according to a predetermined desired value using a control device; and repeating the trimming at temporally predetermined intervals using a time control device.

12. The method as claimed in claim 11, wherein the oscillation frequency is controlled in a predetermined maximum time.

13. The method as claimed in claim 11, wherein the hearing apparatus stores a plurality of trimming values for a plurality of desired oscillation frequencies.

14. The method as claimed in claim 11, wherein the trimming is triggered immediately before transmitting a data from or to the hearing apparatus.

15. The method as claimed in claim 11, wherein the trimming is triggered by an external command.

16. The method as claimed in claim 11, wherein the oscillation frequency is automatically controlled during the trimming according to the predetermined desired value.

* * * * *